US009208960B2

(12) United States Patent
Tomiyasu et al.

(10) Patent No.: US 9,208,960 B2
(45) Date of Patent: Dec. 8, 2015

(54) ELECTRODE FOR VACUUM CIRCUIT BREAKER, AND VACUUM INTERRUPTER USING THE ELECTRODE

(71) Applicant: HITACHI, LTD., Tokyo (JP)

(72) Inventors: Kunihiko Tomiyasu, Tokyo (JP); Hiroyuki Shirai, Tokyo (JP); Takashi Sato, Tokyo (JP); Masato Kobayashi, Tokyo (JP)

(73) Assignee: HITACHI, LTD., Tokyo (JP)

( * ) Notice: Subject to any disclaimer, the term of this patent is extended or adjusted under 35 U.S.C. 154(b) by 0 days.

(21) Appl. No.: 14/257,231

(22) Filed: Apr. 21, 2014

(65) Prior Publication Data

US 2014/0367362 A1 Dec. 18, 2014

(30) Foreign Application Priority Data

Jun. 13, 2013 (JP) ..... 2013-124290

(51) Int. Cl.
*H01H 1/06* (2006.01)

(52) U.S. Cl.
CPC ..... *H01H 1/06* (2013.01)

(58) Field of Classification Search
CPC ..... H01H 33/6643; H01H 33/6642; H01H 33/6645; H01H 1/06; H01H 33/6644
See application file for complete search history.

(56) References Cited

U.S. PATENT DOCUMENTS

| | | | | |
|---|---|---|---|---|
| 6,639,169 | B2 * | 10/2003 | Matsui et al. | 218/128 |
| 6,649,855 | B2 * | 11/2003 | Nishijima et al. | 218/128 |
| 6,686,552 | B2 * | 2/2004 | Nishijima et al. | 218/123 |
| 6,740,838 | B2 * | 5/2004 | Matsui et al. | 218/118 |
| 6,765,168 | B2 * | 7/2004 | Takebuchi et al. | 218/123 |
| 6,870,118 | B2 * | 3/2005 | Nishijima et al. | 218/128 |

FOREIGN PATENT DOCUMENTS

| | | |
|---|---|---|
| JP | 2003-086068 A | 3/2003 |
| JP | 2008-135338 A | 6/2008 |

* cited by examiner

*Primary Examiner* — Truc Nguyen
(74) *Attorney, Agent, or Firm* — Mattingly & Malur, PC

(57) ABSTRACT

An electrode for a vacuum circuit breaker comprises a cylindrical conducting body, a contact electrode as a combination electrode, and a plurality of slits provided on a surface area of the cylindrical conducting body, the slits being inclined with respect to an axial direction of the cylindrical conducting body, wherein an angle between the slits and the axial direction of the cylindrical conducting body is smaller as the slit becomes farther away from the contact electrode.

6 Claims, 6 Drawing Sheets

ELECTRODE FOR VACUUM CIRCUIT BREAKER, AND VACUUM INTERRUPTER USING THE ELECTRODE

BACKGROUND OF THE INVENTION

1. Field of the Invention

The present invention relates generally to a vacuum interrupter and in particular to an electrode for a vacuum circuit breaker having a coil for producing a magnetic field.

2. Description of the Related Art

A vacuum circuit breaker is an equipment disposed in a power receiving and distributing system and plays a role of disconnecting a specific portion from the power system when needed. In particular, the vacuum circuit breaker carries out the function of interrupting several thousands to several tens of thousands of amperes of current at the time of an accident.

A vacuum circuit breaker is adapted to make or interrupt a current by touching or detaching a pair of contact electrodes disposed inside a vacuum container with each other. It is widely known in the art that performance of interrupting a current improves by means of an applied magnetic field (hereinafter called the axial magnetic field) that is vertical to the end faces of the contact electrodes applied.

A structure in which a coil portion for producing a magnetic field is provided on the back of a contact electrode is widely adopted for such an electrode for a vacuum interrupter of an axial magnetic field type. An arc which is produced at the time of interrupting current is confined in a magnetic field to prevent the arc from locally heating the surface of the electrode, that is, to distribute a thermal load resulting from the arc to the overall surface of the electrode, such that the current interruption performance improves.

A vacuum interrupter provided with a coil electrode for producing a magnetic field is disclosed in JP-2008-135338-A. In the vacuum interrupter, a cylindrical conducting body is provided on its surface area with slits inclined with respect to the axial direction of the conducting body, thereby forming a coil portion for producing an axial magnetic field.

SUMMARY OF THE INVENTION

The above-mentioned vacuum interrupter provided with the coil electrode for producing a magnetic-field is as below. The inclined slit which is formed on the coil portion so as to produce an axial magnetic field has its inclination angle larger with respect to the axial direction of the cylindrical conducting body. The larger inclination increases the strength of the axial magnetic field; however, there is a problem in that the electric resistance of the coil portion becomes higher with the larger inclination angle.

The present invention has been made to solve the above problem and aims to provide an electrode for a vacuum circuit breaker of axial magnetic field type which achieves both increase in magnetic field strength and reduction in electric resistance.

According to an aspect of the present invention, there is provided an electrode for a vacuum circuit breaker. This electrode includes a cylindrical conducting body and a contact electrode as a combination electrode having a slit provided on the surface area of the cylindrical conducting body, the slit being inclined with respect to an axial direction of the cylindrical conducting body. An angle between the slit and the axial direction of the cylindrical conducting body is smaller as the slit becomes farther away from the contact electrode.

The electrode for a vacuum circuit breaker in the present invention further includes: a plurality of a slits inclined with respect to the axial direction of a cylindrical conducting body, the slits being provided on the surface area of the cylindrical conducting body; and another two types of linear slits, having a different angle to the axial direction of the cylindrical conducting body from that of the above-mentioned slits. The cylindrical conducting body has an end surface passed through by one of the linear slits and the other end surface penetrated by the other of the linear slits.

The two types of linear slits inclined at respective different angles in relation to the axial direction of the cylindrical conducting body are discontinuous.

The present invention can provide a vacuum interrupter on'which an electrode of axial magnetic field type is mounted, the electrode achieving both increase in magnetic field strength and reduction in electric resistance.

BRIEF DESCRIPTION OF THE DRAWINGS

Other objects and advantages of the invention will become apparent from the following description of embodiments with reference to the accompanying drawings in which.

DESCRIPTION OF THE PREFERRED EMBODIMENTS

A vacuum interrupter according to the present invention will hereinafter be described in accordance with illustrated embodiments.

[First Embodiment]

Figure 1:
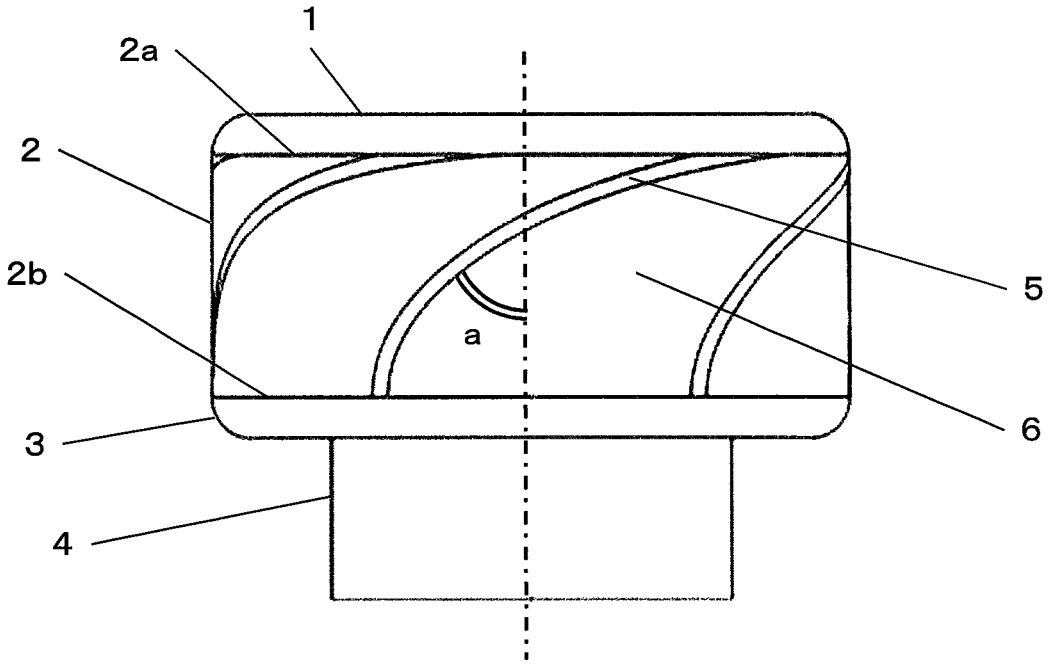
FIG. 1 illustrates an electrode for vacuum interrupter according to a first embodiment of the present invention.

FIG. 1 illustrates a first embodiment of the present invention. FIG. 1 is a side view of an electrode to be mounted on a vacuum interrupter according to the first embodiment of the present invention.

An electrode generally includes a contact electrode 1, a cylindrical conducting body 2, an adaptor 3, and a lead 4. The contact electrode 1 is formed into a disk shape and has one end face in contact with an end face 2*a* of the cylindrical conducting body 2. The adaptor 3 is formed into a disk shape and has one end face in contact with an end face 2*b* of the cylindrical conducting body 2. The adaptor 3 has the other end face in contact with one end face of the lead 4. The contact electrode 1 is made from a material having a high electric conductivity and superior insulation performance, e.g., the material being a copper-based alloy. The cylindrical conducting body 2 is formed into a hollow cylindrical shape and provided with a plurality of slits 5 on its surface area. The slit 5 has an angle a with respect to the axial direction of the cylindrical conducting body and passes through the surface area from the inside toward the outside. The inclination angle $\alpha$ of the slit 5 gradually decreases as the slit 5 becomes farther away from the contact electrode 1.

The vacuum interrupter includes two of the electrodes having a same shape disposed to face each other. The vacuum interrupter carries out making operation and interrupting operation by touching and detaching their contact conducting bodies 1 with each other.

A current that flows into the cylindrical conducting body 2 via the contact electrode 1 passes through a spiral current pathway 6 formed between the slits 5 and reaches the adaptor 3. As a result, a magnetic field is produced in the axial direction of the cylindrical conducting body 2. The magnetic field strength is proportional to the product of the magnitude of the current flowing in the current pathway 6 and the length of the circumferential loop of the current pathway 6. The circumferential loop is elongated to raise the magnetic field strength when the inclination angle $\alpha$ of the slit rises.

With the inclination angle $\alpha$ developing, however, a cross-sectional area of the current pathway 6 vertical to the current flowing direction is reduced to increase electric resistance.

The magnetic field resulting from the current pathway 6 becomes gradually smaller as it is farther away in the axial direction of the cylindrical conducting body. Among the magnetic fields produced between the electrodes, therefore, a magnetic field produced between the electrodes at a portion of the current pathway 6 closer to the contact electrode 1 is greater than a magnetic field produced between the electrodes at a portion of the current pathway 6 closer to the adaptor 3.

On the other hand, electric resistance depends on the electric conductivity, length, and cross-sectional area of a conducting body regardless of a distance from the middle of the pair of the electrodes. The current pathway 6 that is closer to the contact electrode 1 and in which the produced magnetic field has a significant influence on the inter-electrodes is raised in inclination angle $\alpha$. In addition, the current pathway 6 that is closer to the adaptor 3 and in which the produced magnetic field has a small influence on the inter-electrodes is lowered in inclination angle $\alpha$. Thus a growth in electric resistance can be suppressed.

As described above, the present embodiment can provide the electrode for an axial magnetic field type vacuum interrupter configured to achieve both increase in magnetic field strength and reduction in electric resistance.

[Second Embodiment]

Figure 2:
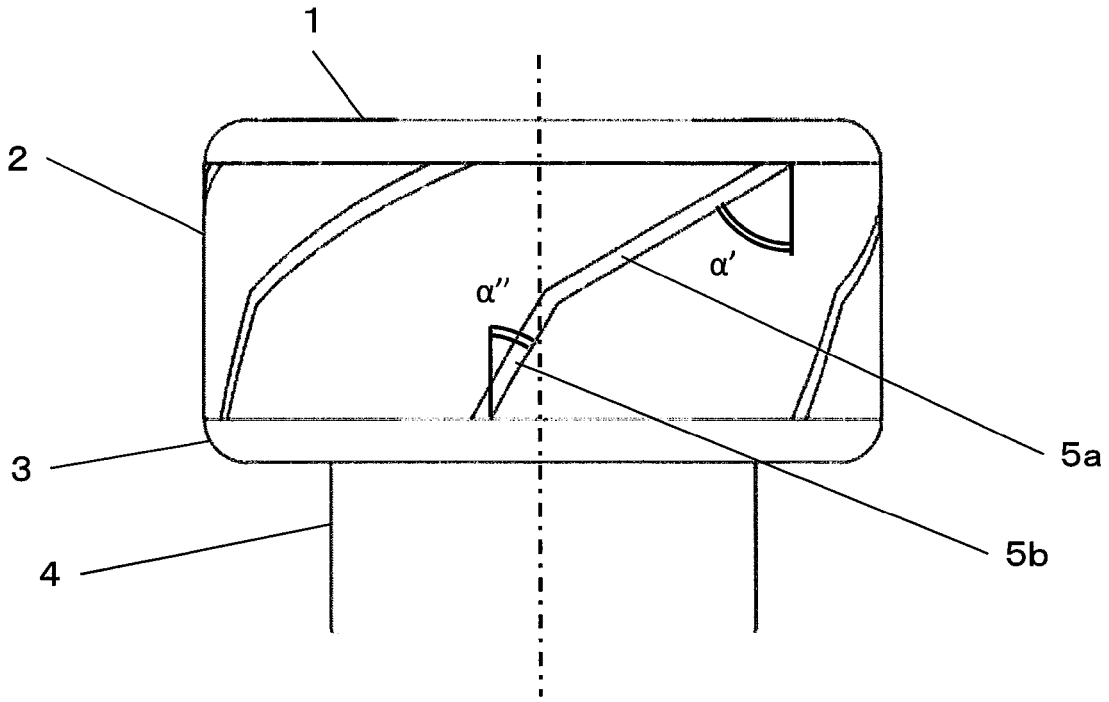
FIG. 2 illustrates an electrode for vacuum interrupter according to a second embodiment of the present invention.

FIG. 2 illustrates a second embodiment of the present invention. In FIG. 2 an electrode for a vacuum interrupter according to the second embodiment has a structure in which the inclined slit in the first embodiment is replaced with two linear slits 5*a*, 5*b*. The provision of the slit whose inclination angle continuously varies as shown in FIG. 1 leads to difficulty in terms of a processing technique, as well as raises costs. To avoid a cost escalation , there is a method in which the linear slit 5*a* is provided close to the contact electrode and the linear slit 5*b* close to the adaptor. In this case, an angle $\alpha'$ of the linear slit 5*a* with respect to the axial direction of the cylindrical conducting body is greater than an angle $\alpha''$ of the linear slit 5*b* with respect to the axial direction of the cylindrical conducting body.

With the structure as described above, the present embodiment can provide the electrode for an axial magnetic field type vacuum interrupter configured to achieve both increase in magnetic field strength and reduction in electric resistance and reduce production costs.

[Third Embodiment]

Figure 3:
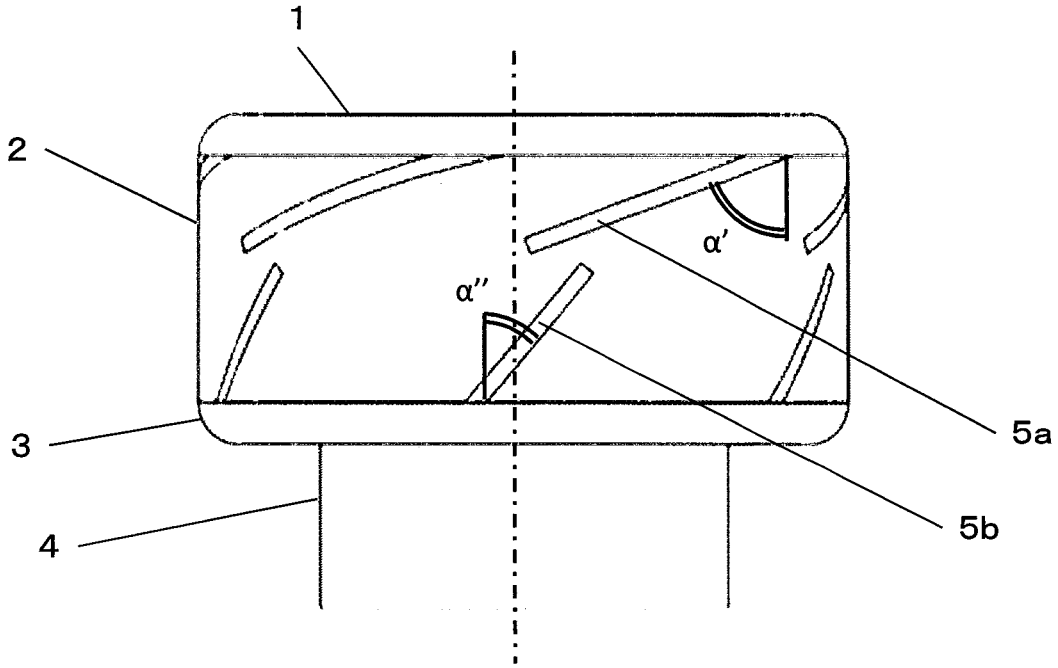
FIG. 3 illustrates an electrode for vacuum interrupter according to a third embodiment of the present invention.

FIG. 3 illustrates a third embodiment of the present invention. In FIG. 3 an electrode for an axial magnetic field type vacuum interrupter according to the third embodiment has a structure in which the slit 5*a* close to the contact electrode and the slit 5*b* close to the adaptor in the second embodiment are discontinuous. The inclined slit 5 in the first embodiment and the linear slits 5*a* and 5*b* in the second embodiment pass through the cylindrical conducting body from one end face thereof to the other end face thereof. The cylindrical conducting body 2 is then divided into the same number of portions as the inclined slits. This leads to difficulty in terms of assembling and also increases assembling costs. To eliminate such disadvantages, the linear slits 5*a* and 5*b* are discontinuous as illustrated in FIG. 3. Thus, the cylindrical conducting body can be processed without being divided.

With the structure as described above, the present embodiment can provide the electrode for an axial magnetic field type vacuum interrupter configured to achieve both increase in magnetic field strength and reduction in electric resistance and reduce production costs.

[Fourth Embodiment]

Figure 4:
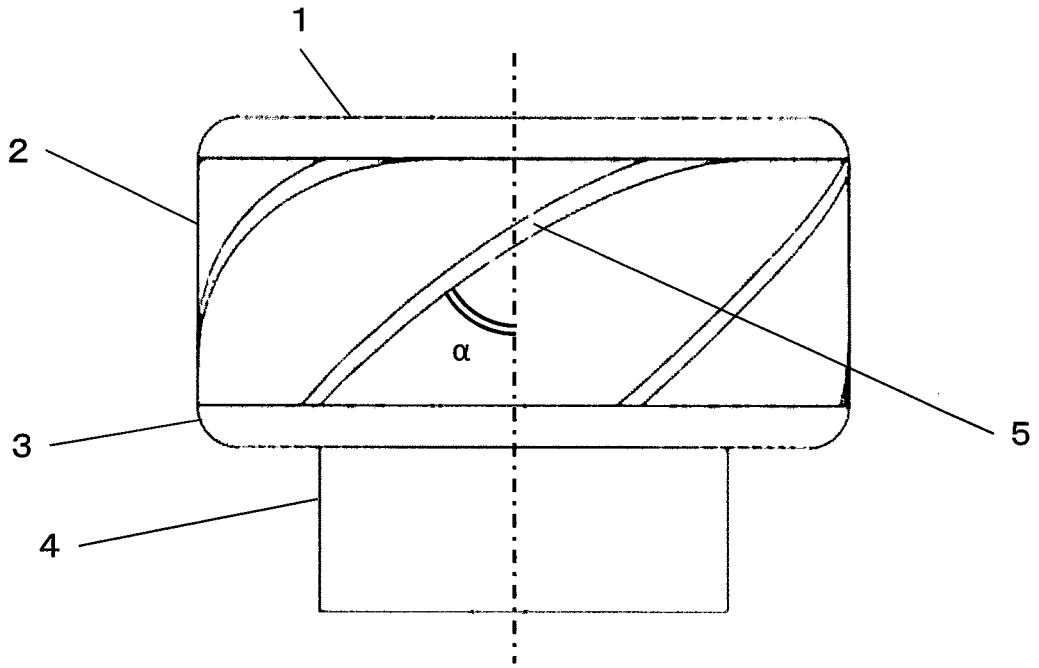
FIG. 4 illustrates an electrode for vacuum interrupter according to a fourth embodiment of the present invention.
Figure 5:
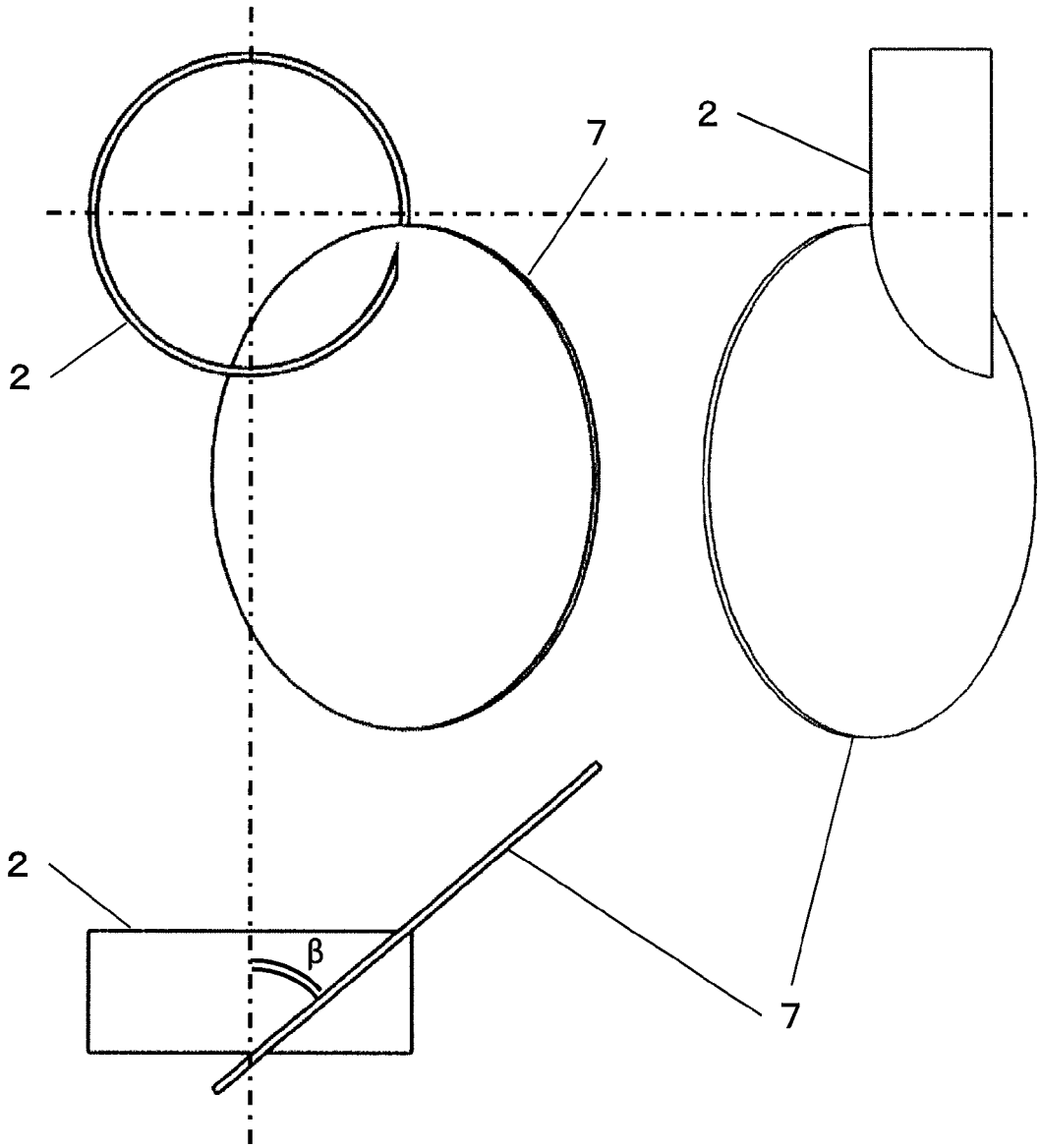
FIG. 5 illustrates a processing method for realizing the structure of the fourth embodiment.

FIG. 4 illustrates a fourth embodiment of the present invention. In FIG. 4 an electrode according to the fourth embodiment forms the inclined slits that continuously vary by means of a disk-shaped cutter. As shown in FIG. 5, a disk-shaped cutter 7 which is inclined at an angle $\beta$ with respect to the axial direction of the cylindrical conducting body 2 is inserted to be parallel to the end face of the cylindrical conducting body 2. The cutter 7 is inserted in such a manner that the leading end of the cutter 7 will be coincident with the contact side end of the inclined slit 5 formed on the surface area of the cylindrical conducting body.

Such a processing method makes it possible to reduce to one time the number of times of cutting processes which used to require at least twice. It further enables to provide the electrode for an axial magnetic field type vacuum interrupter configured to achieve both increase in magnetic field strength and reduction in electric resistance and reduce production costs.

[Fifth Embodiment]

Figure 6:
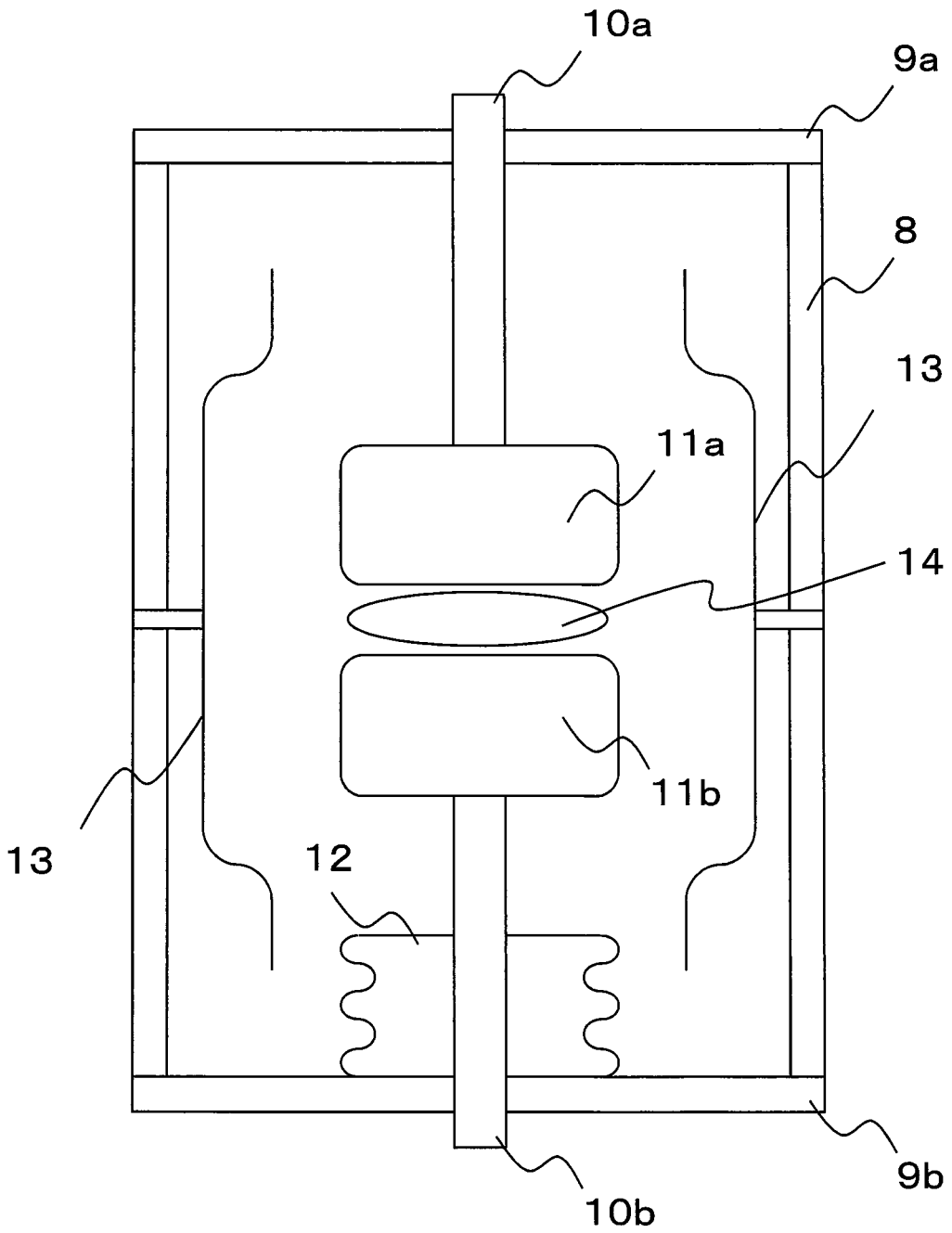
FIG. 6 illustrates a vacuum interrupter according to a fifth embodiment of the present invention.

FIG. 6 is a schematic view of a vacuum interrupter using an electrode for a vacuum circuit breaker according to a fifth embodiment of the present invention. The vacuum interrupter of the present embodiment includes an insulating cylinder 8, end plates 9*a* and 9*b*, a fixed lead 10*a*, a movable lead 10*b*, a fixed electrode 11*a*, a movable electrode 11*b*, a bellows 12, and a shield 13.

The insulating cylinder 8 is formed into a cylindrical shape and has both its end faces covered by the respective end plates 9*a* and 9*b* made of disk-shaped metal. The fixed electrode 11*a* is secured to the leading end of the fixed lead 10*a* passed through and secured to the end plate 9*a*. On the other hand, the movable lead 10*b* movable through the end face 9*b* is mounted by way of the bellows 12. The movable electrode 11*b* is secured to the leading end of the movable lead 10*b*. The shield 13 for protecting the insulating cylinder 8 is provided around the fixed electrode 11*a* and the movable electrode 11*b*. The fixed electrode 11*a* and the movable electrode 11*b* have the electrode structure illustrated in the first, second, third, or fourth embodiment.

The operation of the vacuum interrupter to interrupt a current is described with reference to FIG. 6. The movable electrode 11*b* is driven by an operating device, which is not shown, in a direction opposite to the fixed electrode 11*a*. The fixed electrode 11*a* and the movable electrode 11*b* are thereby opened to produce an arc 14 in the middle of the two electrodes. A current flows into the contact electrode 1 via the arc 14 and then goes to the fixed lead 10*a* or the movable lead 10*b* by way of the cylindrical conducting body 2.

With the structure as described above, the present embodiment can provide an axial magnetic field type vacuum interrupter configured to achieve both increase in magnetic field strength and reduction in electric resistance, as well as lower production cost.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An electrode for a vacuum circuit breaker, comprising:

a cylindrical conducting body;

a contact electrode as a combination electrode; and a plurality of slits provided on a surface area of the cylindrical conducting body, the slits being inclined with respect to an axial direction of the cylindrical conducting body, wherein an angle between the slits and the axial direction of the cylindrical conducting body is smaller as the slit becomes farther away from the contact electrode.

2. An electrode for a vacuum circuit breaker, comprising:

a cylindrical conducting body; and a plurality of slits provided on a surface area of the cylindrical conducting body, the slits being inclined with respect to an axial direction of the cylindrical conducting body, wherein each of the plurality of slits includes two types of linear slits which are different from each other in the angle between the slit and the axial direction of the cylindrical conducting body, and one of the linear slits passes through one of end faces of the cylindrical conducting body and the other of the linear slits passes through the other of the end faces of the cylindrical conducting body.

3. The electrode for a vacuum circuit breaker, according to claim 2, wherein the two types of linear slits inclined at respective different angles with respect to the axial direction of the cylindrical conducting body are discontinuous.

4. A vacuum interrupter on which the electrode for a vacuum circuit breaker according to claim 1 is mounted.

5. A vacuum interrupter on which the electrode for a vacuum circuit breaker according to claim 2 is mounted.

6. A vacuum interrupter on which the electrode for a vacuum circuit breaker according to claim 3 is mounted.

* * * * *